US006503069B2

(12) United States Patent
Moroi et al.

(10) Patent No.: US 6,503,069 B2
(45) Date of Patent: Jan. 7, 2003

(54) SCROLL-TYPE COMPRESSOR WITH AN INTEGRATED MOTOR AND A COMPACT COOLING SYSTEM

(75) Inventors: Takahiro Moroi, Kariya (JP); Ryuta Kawaguchi, Kariya (JP); Tsutomu Nasuda, Kariya (JP); Koji Kawamura, Kariya (JP); Masato Sowa, Kariya (JP); Tatsuyuki Hoshino, Kariya (JP); Yoshiyuki Nakane, Kariya (JP); Hidehito Kubo, Kariya (JP); Hirohisa Katoh, Kariya (JP); Daisuke Satoh, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 09/964,314

(22) Filed: Sep. 26, 2001

(65) Prior Publication Data

US 2002/0071779 A1 Jun. 13, 2002

(30) Foreign Application Priority Data

Sep. 29, 2000 (JP) ..... 2000-299744

(51) Int. Cl.[7] ..... F01C 1/02

(52) U.S. Cl. ..... 418/55.1; 418/83; 417/416.5; 417/372

(58) Field of Search ..... 418/55.1, 83; 417/410.5, 417/372

(56) References Cited

U.S. PATENT DOCUMENTS

| | | | | | |
|---|---|---|---|---|---|
| 2,101,881 | A | * | 12/1937 | Terry et al. | 417/372 |
| 2,963,216 | A | * | 12/1960 | Heitchue, Sr. | 417/371 |
| 4,648,814 | A | * | 3/1987 | Shiibayashi | 418/55.6 |
| 4,696,629 | A | * | 9/1987 | Shiibayashi et al. | 418/55.1 |
| 5,256,042 | A | * | 10/1993 | McCullough et al. | 418/88 |
| 6,183,215 | B1 | * | 2/2001 | Sakai et al. | 417/371 |
| 6,257,840 | B1 | * | 7/2001 | Ignatiev et al. | 417/310 |

FOREIGN PATENT DOCUMENTS

| | | | | |
|---|---|---|---|---|
| JP | A-8-247056 | | 9/1996 | |
| JP | 11-264388 | * | 3/1998 | 418/55.1 |

* cited by examiner

*Primary Examiner*—Thomas Denion
*Assistant Examiner*—Theresa Trieu
(74) *Attorney, Agent, or Firm*—Woodcock Washburn LLP

(57) ABSTRACT

The scroll-type compressor with an integrated motor of the present invention comprises a housing 1, a fixed scroll 21 fixed to the housing 1, a movable scroll 31 installed eccentrically to the fixed scroll 21, and a motor portion 5, and is characterized in that the housing 1 comprises a high pressure chamber 25 to which compressed gases are supplied, a first cooling chamber 26' installed contiguous to the high pressure chamber 25 and to which cooling fluid is supplied, a second cooling chamber 42 which cools the motor portion 5 and is supplied with the cooling fluid, and a fluid passage 7 that connects the first cooling chamber 26' and the second cooling chamber 42 and passes the cooling fluid in the direction from the first cooling chamber 26' to the second cooling chamber 42.

7 Claims, 5 Drawing Sheets

SCROLL-TYPE COMPRESSOR WITH AN INTEGRATED MOTOR AND A COMPACT COOLING SYSTEM

BACKGROUND OF THE INVENTION

1. Field of the Invention

The present invention relates to a scroll-type compressor. More particularly, the present invention relates to a scroll-type compressor with an integrated motor that compresses gases to be supplied to a fuel cell.

2. Description of the Related Art

Recently, a demand for the electric cars are increasing because of the requirement to save petroleum resources. A fuel cell, the power source to propel an electric car, has a high energy conversion efficiency and its reaction products such as water and carbon dioxide are not noxious and are environment-friendly, therefore, a demand for the application thereof are expected to increase. A scroll-type compressor, which can easily be made compact and light, is appropriate to supply the compressed gases to a fuel cell.

From the standpoint of saving energy, it is preferable that the rise in temperature of the air is restricted so that the work load of a scroll-type compressor is as small as possible. Therefore, in the conventional method, a cooling chamber, which circulates cooling water around a high pressure chamber, is provided, heat is exchanged between the air in the high pressure chamber as well as air during compression and the low temperature cooling water, whereby a rise in air temperature can be suppressed and the work Load of the compressor reduced, as in the scroll-type compressor disclosed in Japanese Unexamined Patent Publication (Kokai) No.8-247056.

FIG. 5 is an axial cross-sectional view of a conventional scroll-type compressor. A housing 1, which is the outer shell of a conventional compressor, comprises a front casing 2, on the small-diameter side end face of which a recess is formed, an end plate 20 installed on the small-diameter side end face of the front casing 2, and a rear casing 3 installed on the large-diameter side end of the front casing 2.

A fixed scroll 21 is formed in the axial direction on the large-diameter side of the front casing 2. A suction portion 22 is formed on the outer circumferential side of the fixed scroll 21, and a discharge portion 23 is formed in the center of the inner circumferential side. A disc-shaped discharge valve 24 and a high pressure chamber 25 are formed on a discharge port 20*a* side of the discharge portion 23.

One end of a crank-shaped drive shaft 30 is arranged on the small-diameter side end of the rear casing 3, with rotation being possible. A movable plate 32, with a movable scroll 31 formed in the axial direction, is arranged on the other end of the drive shaft 30, with rotation being possible.

When the drive shaft 30 rotates and the movable scroll 31 orbits, a space enclosed by the fixed scroll 21 and the movable scroll 31 moves toward the center of the fixed scroll 21 while being compressed, therefore, the air in the space is gradually compressed. The compressed air arrives at the discharge portion 23, flows into the high pressure chamber 25 through the discharge valve 24, and is discharged to the outside of the compressor from the discharge port 20*a*.

Cooling water flows into a cooling chamber 26 through a cooling water inflow port, which is not shown. The cooling chamber 26 is contiguous to the high pressure chamber 25 and a border surface 2*a*, through which the heat of the compressed air is transmitted. Therefore, heat is transmitted from the high-pressure air in the high pressure chamber and that during compression to the cooling water. The cooling water, to which heat is transmitted and whose temperature is raised, flows out of the compressor through the cooling water outflow port, which is not shown.

In a conventional scroll-type compressor, high-pressure air and air during compression are cooled to make the compression process as near as possible an isothermal compression so that the work load of the compressor is reduced.

On the other hand, a scroll-type compressor needs a drive means such as a separate motor. A scroll-type compressor with an integrated motor, which combines a compressor and a motor together, enables the whole compression system including a motor to be made compact. Because of this, the scroll-type compressor with an integrated motor is in particular appropriate as a compressor to supply gases, to a fuel cell, which is in a restricted space. The scroll-type compressor with an integrated motor also needs to release heat generated by components, such as a rotor, that rotate at high speed in the motor portion. Therefore, in addition to a cooling chamber in the compressor portion, a cooling means such as a fan was conventionally provided in the motor portion.

A conventional scroll-type compressor with an integrated motor, however, has the following problem. As described above, in a conventional scroll-type compressor with an integrated motor, two cooling means are provided separately in the motor portion and in the compressor portion (a cooling chamber), respectively. Therefore, equipment supporting the cooling means, such as a cooling water circuit in the cooling chamber and a power circuit of the fan, are provided separately, resulting in a large installation space requirement.

The present applicant has attained knowledge that the installation space can be reduced by providing cooling chambers in both the compressor portion and the motor portion as cooling means and by sharing the supporting equipment, such as a cooling circuit, for each cooling chamber.

Before this knowledge can be applied to a compressor for a fuel cell, however, the following problem must be solved. When gases are supplied to a fuel cell, they must be humidified to a certain extent. Therefore, a water vapor exchange film, to humidify discharged gases, is provided in the vicinity of the discharge port of the compressor portion. The water vapor exchange film can resist a temperature of around 140° C. Therefore, it is necessary to lower the temperature of the discharged gases to below this temperature by means of a cooling chamber in the compressor portion. On the other hand, the motor portion can resist a temperature of around 170° C. Therefore, it is necessary to lower the temperature of the motor portion to below this temperature by means of the cooling chamber in the motor portion.

When the cooling circuit is shared, however, the cooling efficiency is better in the cooling chamber to which the cooling fluid is supplied first, of the two cooling chambers, because the temperature of the cooling fluid is low. As a result, the cooling efficiency is worse in the cooling chamber to which the cooling fluid is supplied secondly.

After the above-mentioned knowledge and the application of this knowledge to a scroll-type compressor with an integrated motor for a fuel cell had been researched attentively by the present applicant, it was determined that the temperature of the water vapor exchange film and the motor portion can be lowered to below the resistance temperatures by providing each of the motor portion and the compressor portion with a cooling chamber as a cooling means, respectively, by arranging a single cooling circuit, as supporting equipment, to connect these cooling chambers and to supply the cooling fluid, and by making the cooling fluid flow in the cooling circuit in the direction from the cooling chamber of the compressor portion to that of the motor portion.

The scroll-type compressor with an integrated motor of the present invention has been completed based on the above-mentioned knowledge, and the object is to provide a compressor that requires a reduced installation space, decreases the work load of the compressor, and can resist the required temperature in operation.

To solve the above-mentioned problems, the scroll-type compressor with an integrated motor of the present invention comprises a housing, a fixed scroll fixed to the housing, a movable scroll, which is installed eccentrically to the fixed scroll in the housing and orbits with respect to the fixed scroll, and a motor portion, which is installed in the housing and drives the movable scroll; and is characterized in that the housing has a high pressure chamber into which gases compressed by the fixed scroll and the movable scroll are supplied, a first cooling chamber installed contiguous to the high pressure chamber and to which a cooling fluid is supplied, a second cooling chamber, which cools the motor portion and is supplied with cooling fluid, and a fluid passage, which connects the first cooling chamber and the second chamber and flows the cooling fluid in the direction from the first cooling chamber to the second cooling chamber.

In other words, the scroll-type compressor with an integrated motor of the present invention is characterized in that a first cooling chamber, to which the cooling fluid is supplied, is installed contiguous to the high pressure chamber of the compressor portion, a second cooling chamber, to which the cooling fluid to cool the motor portion is supplied, is provided separately from the first cooling chamber, and a fluid passage that passes the cooling fluid in the direction from the first cooling chamber to the second cooling chamber, is provided.

By installing the first cooling chamber contiguous to the high pressure chamber, gases can be cooled because heat is transferred from the discharged gas and the gas under compression to the cooling fluid in the first cooling chamber and, therefore, the work load of the compressor portion can be reduced. Moreover, by cooling the discharged gas to below the temperature the water vapor exchange film can resist, the water vapor exchange film, of low heat resistance, can be protected.

Moreover, by installing the second cooling chamber, the motor portion can be cooled with the compressor portion, because heat is transferred from the motor portion to the cooling fluid in the second cooling chamber. Because the motor portion is composed of densely arranged components such as iron cores and coils and is hermetically sealed, heat is easily generated and removal of heat is unlikely to take place. By installing the second cooling chamber, the temperature of the motor portion can be lowered and burning in the motor portion can be suppressed.

Furthermore, by connecting the first cooling chamber and the second cooling chamber with a fluid passage and flowing the cooling fluid from the first cooling chamber to the second cooling chamber, the motor portion and the water vapor exchange film installed together in the compressor portion can be effectively cooled to below the resistance temperature.

The present invention may be more fully understood from the description of the preferred embodiments of the invention set forth below, together with the accompanying drawings.

DESCRIPTION OF THE PREFERRED EMBODIMENTS

Basic embodiments and modified embodiments thereof of the scroll-type compressor with an integrated motor of the present invention are described below with reference to the drawings for each embodiment.

<Basic Embodiments>

Figure 1:
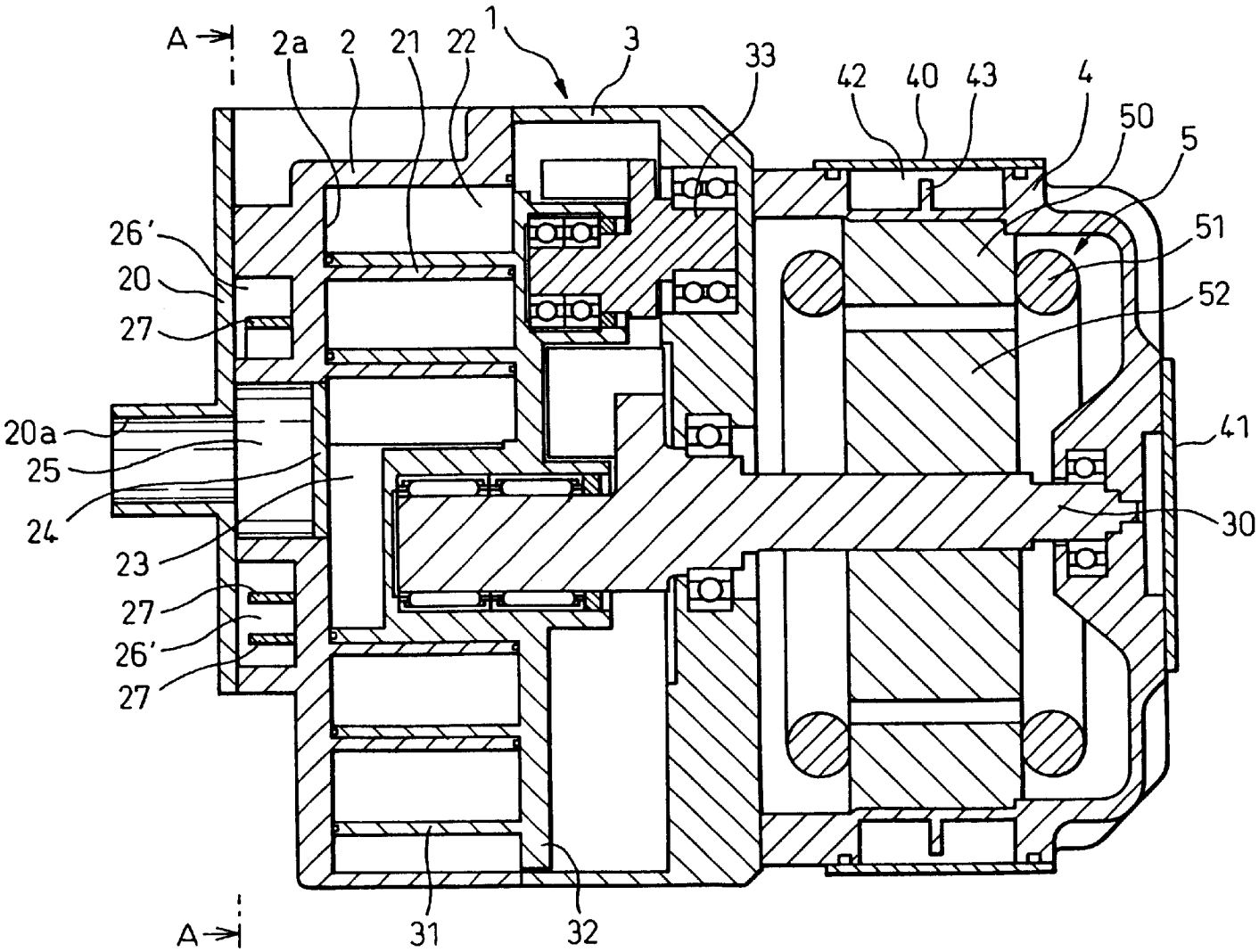
FIG. 1 is an axial cross-sectional view of the scroll-type compressor with an integrated motor of the present invention.

FIG. 1 is an axial cross-sectional view of a scroll-type compressor of the present invention. A housing 1 of the scroll-type compressor with an integrated motor of the present invention comprises: a front casing 2, which is made of aluminum alloy and has a cylindrical shape of different diameters, on the small-diameter side end face of which recesses are formed; an end plate 20, which is made of aluminum alloy, having a disc like shape and a discharge port 20*a* in the center, and is installed on the small-diameter side end face of the front casing 2; a rear casing 3, which is made of aluminum alloy and has a bowl-like shape, installed on the large-diameter side end of the front casing 2; a bowl-shaped motor casing 4, which is made of aluminum alloy and is installed on the bottom surface of the rear casing 3, having a motor portion 5 internally and a ring-shaped recess formed on the outer circumferential surface; a ring-shaped outer circumferential plate 40, which is made of aluminum alloy and installed so as to cover the recess; and a disk-like bottom plate 41, which is made of aluminum alloy and installed so as to cover the bottom surface of the motor casing 4.

A first cooling chamber 26' is surrounded by the recess of the small-diameter side end surface of the front casing 2 and the inner surface of the end plate 20. The first cooling chamber 26' comprises a cooling water inflow port and a cooling water outflow port, which are not shown, and the radial cross-sectional view of the first cooling chamber 26' is a U-shape running from the cooling water inflow port to the cooling water outflow port. On the larger-diameter side of the front casing 2, a fixed scroll 21 is formed, extending in the axial direction from a border surface 2*a* between the large-diameter side and the small-diameter side. A chip seal is arranged on the fixed scroll end. A suction portion 22 is formed near the outer circumferential side of the fixed scroll 21 and a discharge portion 23 is formed in the center near the inner circumferential surface of the fixed scroll 21. A disc-like discharge valve 24 is installed near the discharge port

20*a* of the discharge portion 23, and a high pressure chamber 25 is positioned much nearer the discharge port 20*a* than the discharge valve 24.

A crank-shaped drive shaft 30, which is made of cast iron and has a balance weight, is arranged via a ball bearing on the small-diameter side end of the rear casing 3 so that rotation is possible. On the other end of the drive shaft 30, a disc-like movable plate 32, which is made of aluminum alloy, and from the surface of which a movable scroll 31 is formed so as to extend in the axial direction, is arranged via bearings so that rotation is possible. The end portion of the fixed scroll 21, which extends from the border surface 2*a* of the opposing front casing 2, comes into contact with the surface of the movable plate 32. The chip seal is arranged on the end portion of the movable scroll 31 and the end portion of the movable scroll 31 comes into contact with the border surface 2*a*. That is, the fixed scroll 21 and the movable scroll 31 are arranged in a manner where one is turned at 180 degrees relative to the other so as to superpose on each other, between the border surface 2*a* and the movable plate 32, and a space, which compresses air, is formed by the border surface 2*a*, the fixed scroll 21, the movable plate 32, and the movable scroll 31. One end of a crank-shaped orbiting shaft 33, which is made of cast iron and has a balance weight, is arranged near the outer circumferential surface of the movable plate 32 via ball bearings so that rotation is possible. The other end of the orbiting shaft 33 is arranged on the rear casing 3 via ball bearings so that rotation is possible. A cooling water inflow port, the cooling water outflow port, and an air suction port are arranged on the right side when viewed with the end plate 20 as the front side and, therefore, they are not shown in FIG. 1.

A second cooling chamber 42 is surrounded by the recess of the outer circumferential surface of the motor casing 4 and an outer circumferential plate 40 formed annularly around the motor portion 5. A ring-shaped heat radiation fin 43 is erected on the bottom face of the recess.

In the inner side of the motor casing 4, the motor portion 5, which comprises a ring-shaped stator 50 which is installed on the inner circumferential surface of the motor casing 4, a coil 51 wound around a slit, which are not shown, of the stator 50, a ring-shaped rotor 52 which is made of magnet and installed in the inner circumferential direction of the stator 50, part of the drive shaft 30 installed in the center of the rotor 52, and the ball bearing that holds the drive shaft 30 in the bottom of the motor casing 4 so that rotation is possible, is arranged.

When the drive shaft 30 rotates, a rotational force is transmitted to the movable plate 32, and the movable plate 32 orbits around the drive shaft 30. When the movable plate 32 orbits, the movable scroll 31 formed on the movable plate 32 orbits along the fixed scroll 21. Because the orbiting shaft 33 is arranged on the movable plate 32, on which the movable scroll 31 is formed, the self-rotation of the movable scroll 31 is prevented. Air flows from a suction port, which is not shown, and flows into the suction portion 22 connected to the suction port. When the movable scroll 31 orbits, the space surrounded by the fixed scroll 21 and the movable scroll 31 moves toward the center of the fixed scroll 21 while being reduced in volume, therefore, the air that fills the space is gradually compressed. The compressed air arrives at the discharge portion 23 in the center near the inner circumferential surface of the fixed scroll 21, flows into the high pressure chamber 25 through the discharge valve 24, and is discharged to the outer side of the compressor from the discharge port 20*a*.

Figure 2:
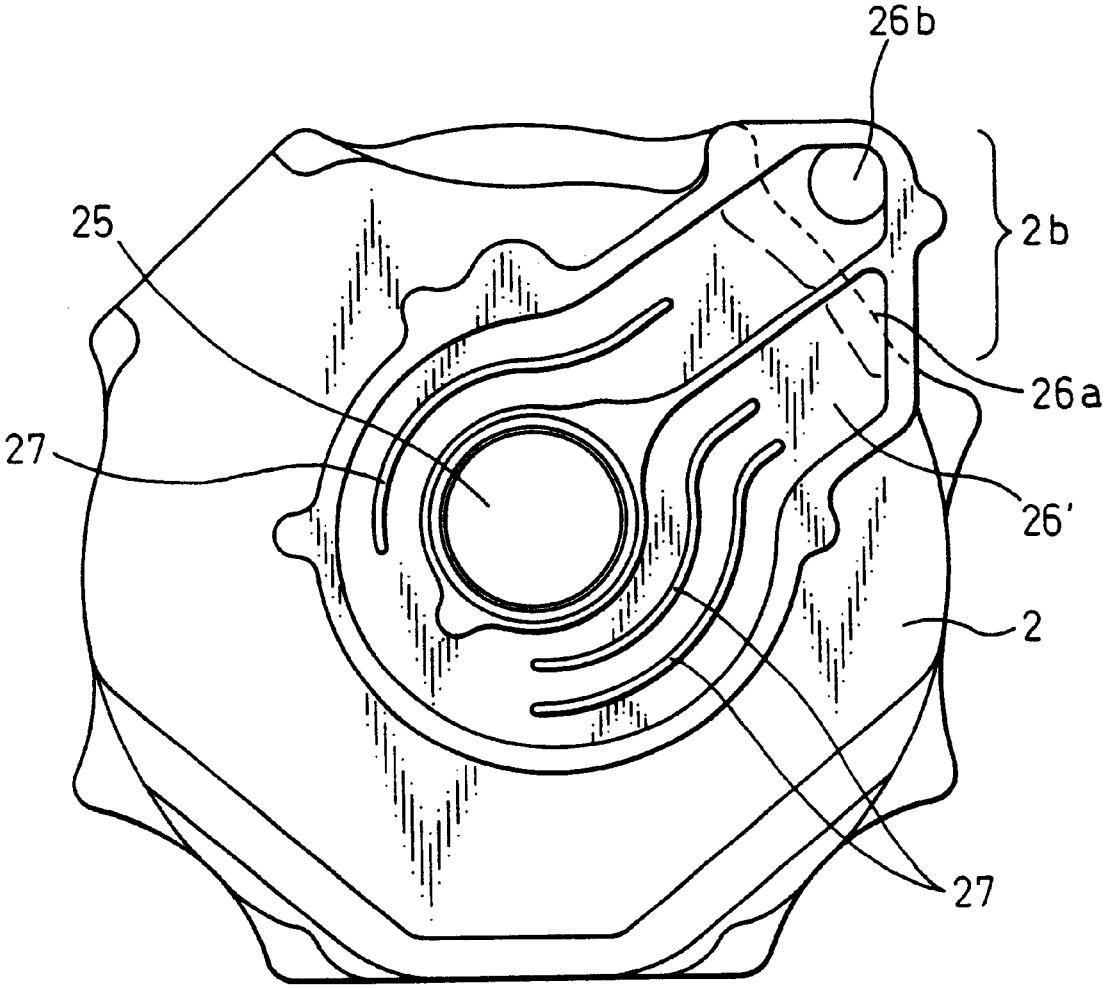
FIG. 2 is a cross-sectional view taken along line A—A in FIG. 1.

FIG. 2 is a section view taken along lines A—A in FIG. 1. The first cooling chamber 26', which is disposed on an opposite side of the fixed scroll 21, annularly surrounds the high pressure chamber 25 which is also disposed on the opposite side of the fixed scroll 21. The first cooling chamber 26' is formed in a U-shape around the high pressure chamber 25 and one end of the first cooling chamber 26' is an inflow end portion 26*a*, and the other end is an outflow end portion 26*b*. Heat radiation fins 27 are erected in the first cooling chamber 26'. The inflow end portion 26*a* and the outflow end portion 26*b* are installed on a portion 2*b*, which is formed by expanding, in the radial direction, the main body of the compressor located in the upper right of the front casing 2. Because the recess in FIG. 1 does not exist on the rear side of the portion 2*b*, a member, which has an inner circumferential surface as a recess, is arranged on the rear sides of the inflow end portion 26*a* and the outflow end portion 26*b*.

Figure 3:
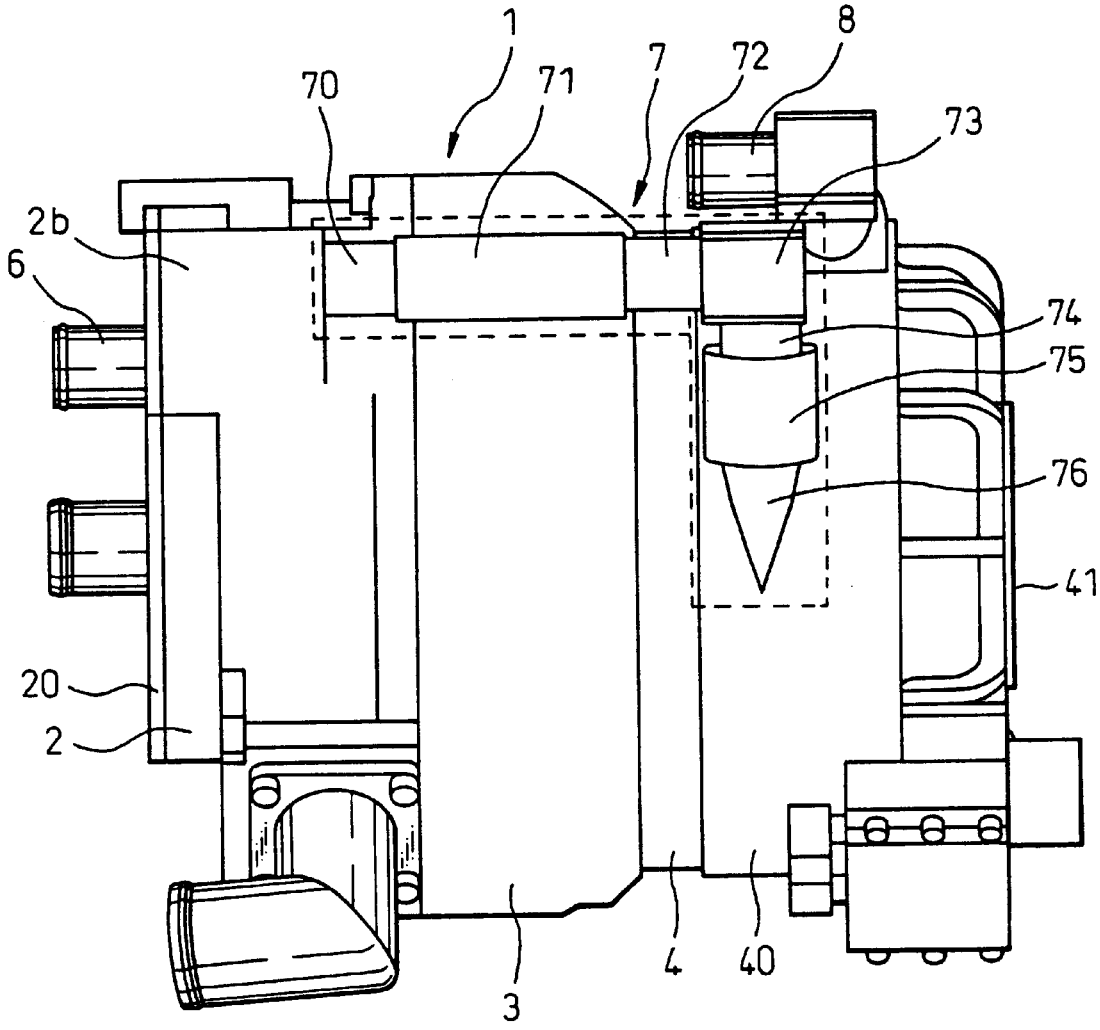
FIG. 3 is a right profile cross-sectional view of the scroll-type compressor with an integrated motor of the present invention.

FIG. 3 is a right profile view of the scroll-type compressor with an integrated motor in the present embodiment. A cylindrical steel inflow portion 6 is screwed into the end plate 20, and penetrates as far as the inflow end portion 26*a* of the first cooling chamber 26' in FIG. 2. One end of a first pipe 70 is screwed into the portion 2*b* of the front casing 2 and penetrates as far as the outflow end portion 26*b* of the first cooling chamber 26' in FIG. 2. On the other hand, an inflow pipe 76 is welded to the second cooling chamber 42 in FIG. 1. Between the first pipe 70 and the inflow pipe 76, a rubber hose 71, a second pipe 72, a joint member 73, a third pipe 74, and a fourth pipe 75 are arranged in this order, and a fluid passage 7, which is indicated by a dotted line in FIG. 3, is formed. Pipes 70, 72, 74 and 75 are preferably made from steel. The pipes 70 and 72 are press-inserted into and connected to the rubber hose 71. The pipes 72 and 74 are screwed into and connected to the joint member 73. The third pipe 74 and the inflow pipe 76 are screwed into and connected to the fourth pipe 75. Sealing members are wound on thread ridges and grooves of these screwed connections to ensure fluid-tightness. A cylindrical steel outflow portion 8, which is connected to the second cooling chamber 42 in FIG. 1, is arranged on the upper portion of the outer circumferential plate 40.

The flow of the water, which is the cooling fluid in the scroll-type compressor with an integrated motor of the present embodiment, is described below. The water flows from the inflow portion 6 shown in FIG. 3 and flows through the inflow end portion 26*a* shown in FIG. 12 into the first cooling chamber 26'. The water circulates in the U-shape passage in the first cooling chamber 26' and flows through the outflow end portion 26*b* into the fluid passage 7 shown in FIG. 3. The water moves in the fluid passage 7 parallel to the axial direction of the compressor and flows through the inflow pipe 76, which penetrates the outer circumferential plate 40, into the second cooling chamber 42 shown in FIG. 1. The water, which circulates in a ring-shaped passage in the second cooling chamber 42, flows out of the compressor from the outflow portion 8 shown in FIG. 3. Although not shown here, a radiator that cools the heated water and a pump that pumps the water, are arranged outside the compressor, and the water is cooled by the radiator and flows into the compressor again from the inflow portion 6.

In the present embodiment, the housing 1 comprises the end plate 20, the front casing 2, the rear casing 3, the motor casing 4, the outer circumferential plate 40, and the bottom plate 41. In addition to the present embodiment in which the housing is composed of connected plural members, an embodiment in which the housing is integrally composed of a single member can be realized. Moreover, in the present embodiment, the fixed scroll 21 is formed on the border surface 2*a* of the front casing 2 and is fixed to the housing, but an embodiment in which a member having a fixed scroll is installed separately in the housing also corresponds to the embodiment in which the fixed scroll is fixed to the housing.

In the present embodiment, air is the gas that is compressed in the compressor, but type of gas is not restricted. If a measure to further improve the gas tightness in the compressor portion is employed, gas such as hydrogen, which is a fuel of a fuel cell, can be used.

The sizes of the first cooling chamber and the second cooling chamber are not restricted. For example, in the embodiment in which the first cooling chamber is enlarged radially, the cooling efficiency of the gas during compression is improved and the work load of the compressor can be reduced. On the other hand, it is more preferable if the mass flow (kg/h) of the sucked gas is larger when the gas is sucked in from the outer circumferential side of the compressor, because the mass flow of the discharged gas that relates to the battery reaction becomes larger. Usually the volume flow ($m^3$/h) of the gas sucked through the compressor is constant. Because of this, the higher the density of the sucked gas is, the larger the mass flow thereof is. In the embodiment in which the radial size of the first cooling chamber is reduced, the sucked gas does not expand because it is not likely that the sucked gas taken into the compressor from the outer circumferential portion of the housing will be heated, and the density thereof can be prevented from decreasing. Because of this, the density of the discharged gas can be prevented from decreasing and the mass flow of the discharged gas can be maintained.

The shapes of the first cooling chamber and the second cooling chamber are not restricted in particular. In the present embodiment in which the heat radiation fins are provided in the first cooling chamber and the second cooling chamber, the cooling efficiency is improved because the area of heat-transfer surface becomes larger. Moreover, in order to further enlarge the area of heat-transfer surface, an embodiment in which a partitioning wall, between the cooling chamber and the high pressure chamber, is designed to have a corrugated shape can also be realized.

In the present embodiment, both the first cooling chamber and the second cooling chamber are formed in a manner that plate-like members are installed to the casing having recesses from the outer side. In the present embodiment in which the cooling chamber is formed in the above-mentioned manner, it is easier to form a cooling chamber. Moreover, another embodiment, in which a member, having a cooling chamber internally, is produced separately from the compressor and the member is installed to the casing, can also be realized. This embodiment has more excellent fluid-tightness because there is no seam on the wall of the cooling chamber. In this case, the member that has a cooling chamber internally constitutes part of the housing.

Moreover, the materials that form the cooling chamber are not restricted in particular. In the present embodiment, the first cooling chamber and the second cooling chamber are made of aluminum alloy. In the present embodiment, the cooling efficiency is improved because the aluminum alloy has an excellent coefficient of heat transfer. However, an embodiment in which the cooling chamber is made of materials such as cast-iron can be realized.

In the present embodiment, water is used as a cooling fluid, but the type of cooling fluid is not restricted in particular. A fluid that is liquid at the operating temperature and that does not corrode the equipment can be selected. There may be an embodiment in which pure water generated from the fuel cell is used as the cooling fluid.

Although, in the present embodiment, the fluid passage is constructed by connecting plural members, the number of members is not restricted in particular, and there can be an embodiment in which the fluid passage is constructed integrally with members such as flexible pipes or rubber hoses. In this embodiment, the number of steps for assembling can be reduced and a fluid passage can be arranged more easily. Moreover, this embodiment has a more excellent fluid-tightness compared to the case where a fluid passage is constructed with plural members. The shape and area of a fluid passage can be determined adequately from the relation to the required flow of the cooling fluid. Moreover, the materials that form a fluid passage are not restricted in particular. Any materials that are not corroded by the cooling fluid and have a required heat resistance, strength etc. can be used adequately. An embodiment where a fluid passage is installed inside the housing is described in detail later.

In the present embodiment, the first cooling chamber and the second cooling chamber are arranged in a single cooling circuit. By arranging the two cooling chambers in a single cooling circuit, the present embodiment has advantages with respect to space and cost. Moreover, an embodiment, where the first cooling chamber and the second cooling chamber are installed additionally to the cooling circuit to cool other equipment mounted on a car, and so on, can be realized. Because an additional cooling circuit need not be installed separately, this embodiment has further advantages with respect to space and cost. Further, another embodiment, where a cooling circuit is not formed and the cooling fluid is discarded after use, can be realized. Because a circuit is not formed, the equipment can be simplified and is small.

Furthermore, the type, the internal arrangement etc. of the motor are not restricted in particular. In the present embodiment, a motor of an inverter type is used, but there may be an embodiment where a direct current motor is used as is. Moreover, the shapes of a rotor and a stator, the arrangement of coils and magnets, and so on in the motor portion, are not restricted in particular. In the present embodiment, a motor in which coils are arranged on the stator side and the magnet is arranged on the rotor side, is used, but there may be another embodiment, where the opposite arrangement, that is, the magnet is arranged on the stator side and the coils are arranged on the rotor side, is employed.

Although the drive shaft of the movable scroll in the compressor portion is used as the motor rotating shaft in the present embodiment, there may be another embodiment where the movable scroll drive shaft and the motor rotating shaft are arranged separately and a rotation transmitting mechanism is provided therebetween. In such embodiment, the drive shaft of the present invention is composed of the motor rotating shaft, the rotation transmitting mechanism, and the movable scroll drive shaft. The rotational speed of the motor rotating shaft and the movable scroll drive shaft can be changed in an embodiment where a rotational speed converting mechanism is provided in the rotation transmitting mechanism.

<Modified Embodiments>

Figure 4:
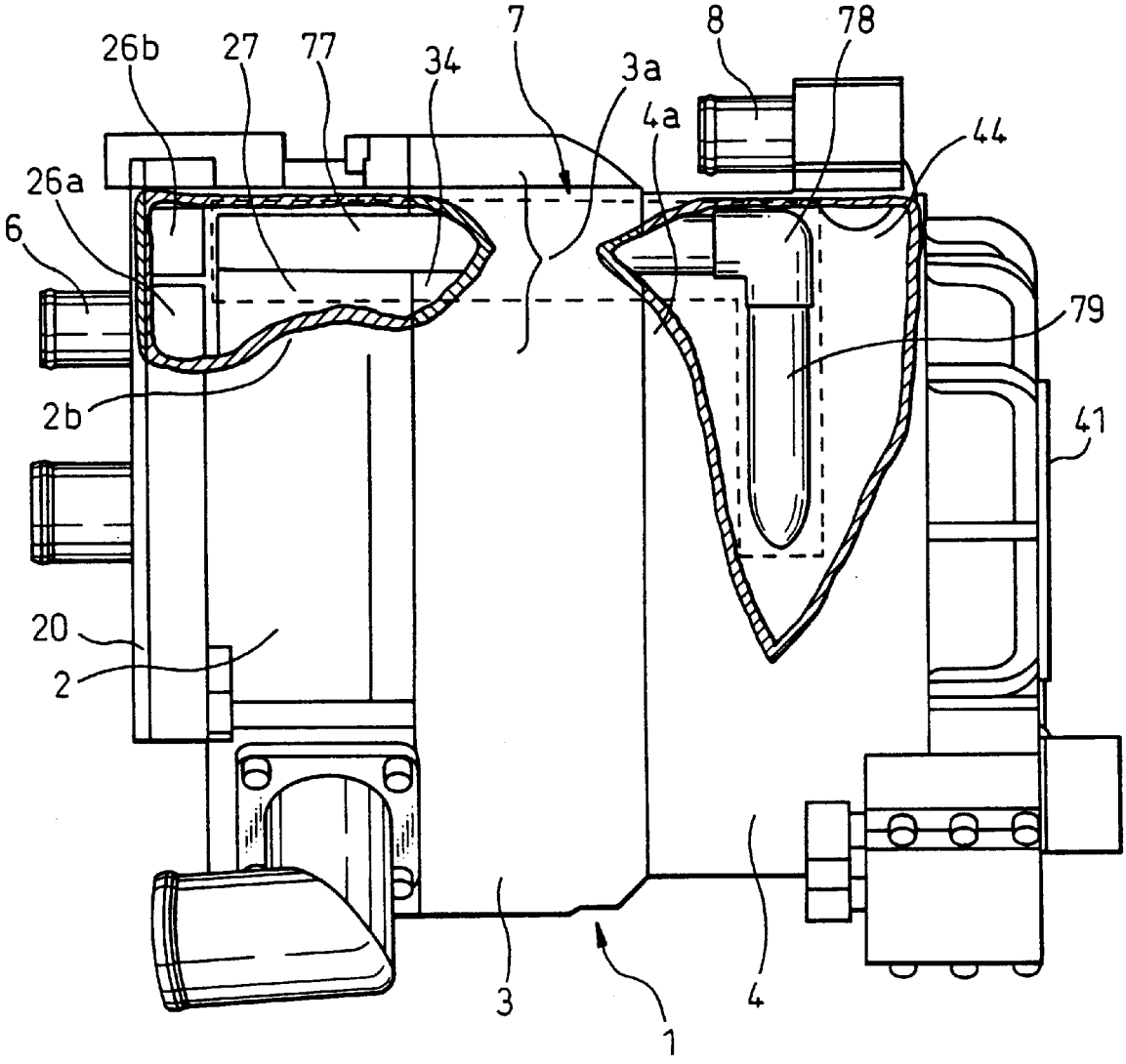
FIG. 4 is a partial cross-sectional view of the scroll-type compressor with an integrated motor comprising an internal fluid passage.
Figure 5:
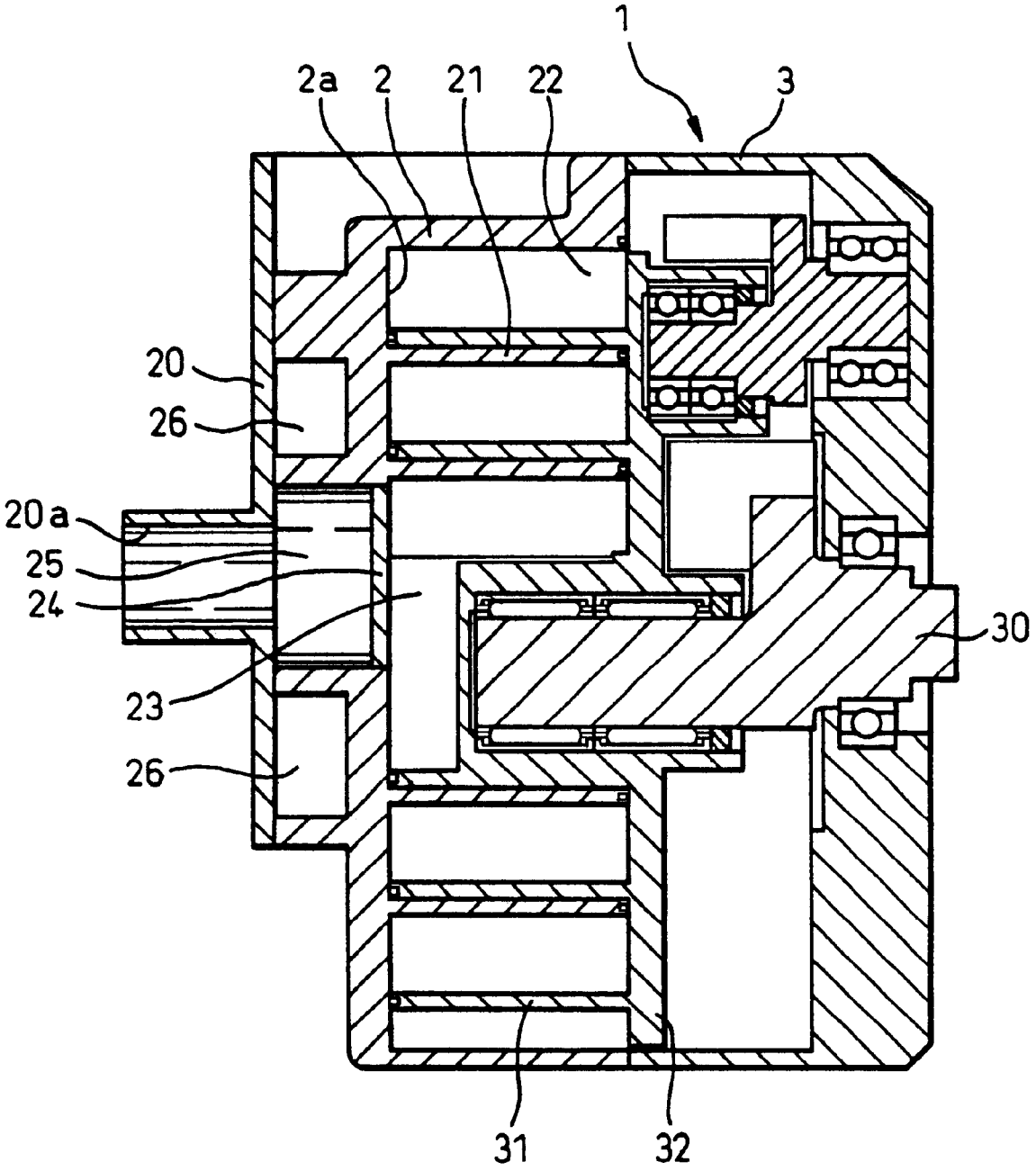
Fig. 5 Prior Art
FIG. 5 is an axial cross-sectional view of a scroll-type compressor of a conventional type.

The scroll-type compressor with an integrated motor of the present invention can also be composed so that the fluid passage for the cooling fluid, which is installed outside of the housing in the basic embodiments, is installed inside the housing. FIG. 4 is a partial cross-sectional view of the compressor with an integrated motor in which the fluid passage is arranged inside the housing.

The housing 1 of the compressor with an integrated motor in the present embodiment comprises the end plate 20, the front casing 2, the rear casing 3, the motor casing 4, a cooling member 44, and the bottom plate 41. A ring-shaped second cooling chamber is formed in circumferential direction inside the cooling chamber 44. A front partition 27, which is made of aluminum alloy and is ring-shaped, is installed on the inner side of the inner circumferential surface of the front casing 2, and a space is formed between the front partition 27 and the portion 2*b*. A rear partition 34, which is also made of aluminum alloy and has a ring-shaped, is also installed on the inner side of the inner circumferential surface of the rear casing 3. A portion 3*a*, which extends in the axial direction and the diameter of which is larger than those of other portions, is formed in the rear casing 3, and a space, that is connected to the space within the above-mentioned front casing, is formed between the rear partition 34 and the portion 3*a*. Furthermore, a portion 4*a*, the diameter of which is large than those of other portions, is formed in the motor casing 4, and a space, that is continuous to the space within the above-mentioned front casing and that within the rear casing, is formed between the cooling chamber 44 and the portion 4*a*.

In the present embodiment, the fluid passage 7 is arranged in the space formed continuously from the inner side of the above-mentioned front casing 2 to that of the motor casing 4. The fluid passage 7 comprises a steel pipe 77, one end of which is screwed and connected to the outflow end portion 26*b* of the first cooling chamber, a steel elbow 78, one end of which is screwed and connected to the other end of the steel pipe 77, and a steel inflow pipe 79, one end of which is screwed and connected to the other end of the elbow 78, the other end of which is welded to the cooling member 44, and which penetrates to the second cooling chamber within the cooling member 44.

Because the interference between the fluid passage 7 and other equipment mounted on a car can be prevented by the fluid passage 7 installed within the housing, malfunctions of the fluid passage 7 can be avoided. Furthermore, the fluid passage 7 itself can cool the compressor portion and the motor portion.

In the present embodiment, the fluid passage is installed linearly in parallel with the axial direction, but the installing position of the fluid passage is not restricted, in particular, as long as it connects the first cooling chamber and the second cooling chamber. For example, the fluid passage can be installed in a spiral form on the outer circumferential surface of the front partition, the rear partition, and the cooling member. Or, without installing the expansion portion on the housing, the fluid passage can be installed so that, for example, the fluid passage runs outside the range in which the fixed scroll and the movable scroll orbit, after a means to prevent compressed gases from leaking is applied to the fluid passage. Because the expansion portion is not formed, the size of a compressor can be reduced. Furthermore, there may be an embodiment where the fluid passage is installed partially within the housing. When it is difficult to form a continuous space from the inner side of the front casing to that of the motor casing because of the arrangement of the compressor portion and the motor portion, the embodiment where the fluid passage is installed partially within the housing becomes more practicable. The shape of the fluid passage is not restricted in particular. There may be an embodiment where the heat transfer area of the fluid passage is enlarged in order to improve the cooling effect of the fluid passage itself.

In the scroll-type compressor with an integrated motor of the present invention, the work load of the compressor can be reduced because the cooling chamber is provided. Furthermore, the water vapor exchange film and the motor portion can be cooled efficiently because the fluid passage is designed so that the flow direction is from the first cooling chamber to the second cooling chamber.

While the invention has been described by reference to specific embodiments chosen for the purposes of illustration, it should be apparent that numerous modifications could be made thereto by those skilled in the art without departing from the basic concept and scope of the invention.

What is claimed is:

1. A scroll-type compressor with an integrated motor, comprising a housing, a fixed scroll fixed to said housing, a movable scroll, which is installed eccentrically to said fixed scroll in said housing and orbits along said fixed scroll, and a motor portion, which is installed in said housing and drives said movable scroll, wherein, said housing comprises a high pressure chamber to which gas compressed by said fixed scroll and said movable scroll are supplied, a first cooling chamber installed contiguous to said high pressure chamber, to which a cooling fluid is supplied, and which comprises heat-transfer surface increasing means, a second cooling chamber which cools said motor portion and is supplied with cooling fluid, which is liquid at operating temperatures, and is installed contiguous to the motor portion, and a fluid passage that connects said first cooling chamber and said second cooling chamber and passes said cooling fluid in the direction from said first cooling chamber to said second cooling chamber.

2. A scroll-type compressor with an integrated motor, as set forth in claim 1, wherein said fluid passage is installed inside said housing.

3. A scroll-type compressor with an integrated motor, as set forth in claim 1, wherein said first cooling chamber, which is disposed on an opposite side of said fixed scroll, annularly surrounds said high pressure chamber which is disposed on the opposite side of said fixed scroll.

4. A scroll-type compressor with an integrated motor, as set forth in claim 1, wherein said second cooling chamber annularly surrounds said motor portion.

5. A scroll-type compressor with an integrated motor, as set forth in claim 1, wherein the heat-transfer surface increasing means includes fins.

6. A scroll-type compressor with an integrated motor, as set forth in claim 1, wherein the second cooling chamber comprises heat-transfer surface increasing means.

7. A scroll-type compressor with an integrated motor, as set forth in claim 6, wherein the heat-transfer surface increasing means includes fins.

* * * * *